United States Patent [19]

Kabbaby

[11] Patent Number: 4,601,709

[45] Date of Patent: Jul. 22, 1986

[54] SHOWER-MOUNTED DOUCHE APPARATUS

[76] Inventor: Charles Kabbaby, 4280 S.W. 109th Ave., Davie, Fla. 33328

[21] Appl. No.: 707,733

[22] Filed: Mar. 4, 1985

[51] Int. Cl.[4] ..... A61M 3/00

[52] U.S. Cl. ..... 604/150; 604/279

[58] Field of Search ..... 604/150, 259, 279, 280, 604/246; 239/318

[56] References Cited

U.S. PATENT DOCUMENTS

| | | | |
|---|---|---|---|
| 964,730 | 7/1910 | Ackerman . | |
| 1,861,932 | 6/1932 | Moore . | |
| 1,940,210 | 12/1933 | Frederick | 128/ |
| 3,042,314 | 7/1962 | Packard et al. | 239/318 X |
| 3,104,664 | 9/1963 | Ladd | 604/150 |
| 3,225,759 | 12/1965 | Drapen et al. | 604/150 |
| 3,254,647 | 6/1966 | Vogel | 128/ |
| 3,373,744 | 3/1968 | Kendall | 128/ |
| 3,399,676 | 9/1968 | McLaughlin | 128/ |
| 3,461,870 | 8/1969 | VanLinge | 604/150 |
| 3,847,150 | 11/1974 | Schevermann | 604/150 |
| 4,000,742 | 1/1977 | DiGiacomo | 604/150 X |
| 4,043,337 | 8/1977 | Baugher | 604/150 |
| 4,349,157 | 9/1982 | Beiswenger et al. | 239/318 X |

FOREIGN PATENT DOCUMENTS

| | | | |
|---|---|---|---|
| 1182266 | 6/1959 | France | 239/318 |

*Primary Examiner*—John D. Yasko

*Attorney, Agent, or Firm*—Oltman and Flynn

[57] ABSTRACT

A douche apparatus for attachment between a shower head and its water supply pipe. The apparatus has a manual valve for diverting water from the shower head to a lateral passage leading to the mixing head of a container assembly holding a liquid douche medicament. The mixing head has a venturi passageway into which the douche medicament is drawn up through a siphon tube by the flow of water through the venturi passagway. An adjustable flow control device controls the rate at which the medicament is drawn into the mixing head. A rotatably adjustable fitting attaches the mixing head to the valve so that the siphon tube in the container assembly can be positioned vertical. A douche applicator receives the mixture of water and medicament from the mixing head.

17 Claims, 16 Drawing Figures

20
H
23
29
31
55a
55
54
34
8
4
44
43
42
22
16
15
14
13
12
11
10
9
8
7
6
5
4
3
2
1
41
33
38
40
39
56
57
58
21
20a
24
26
28
27
25
22a
22b
A 120
120a
124
123
200
H
A
127
122b
122a
80
133
122
99
97
95
94
98
89
134a
88
90
93
91
96
86
134
87
92
85
146a
81
84
82
137
138
14
120
123
200
H
122
133a
145
209
128
208
147
156
148
203
206
129
204
205
83
211
212
202
201
207
210
134a
2
8
7
9
6
5
3
1

SHOWER-MOUNTED DOUCHE APPARATUS

SUMMARY OF THE INVENTION

This invention relates to a douche apparatus for attachment to a shower.

Typically, a bathroom shower has a shower head threadedly attached to a water supply pipe extending from a wall of the shower enclosure. The present invention is directed to a douche apparatus for attachment to such a shower to use the shower's water supply for withdrawing douche medicament from a container and mixing with it before its application to the person using it.

The present invention includes a valve body designed to be threadedly attached at one end to the water supply pipe after the shower head is removed from it, and threadedly attached at the opposite end to the shower head. A manually rotatable valve member inside the valve body can be selectively positioned to provide either (1) a water path from the water supply pipe to the shower head or (2) a water path from the water supply pipe to a lateral branch passage in the valve body. A fitting is mounted on the valve body at this branch passage. Attached to this fitting is a mixing head which is the top of a container for liquid douche medicament. This mixing head has a venturi passageway for passing water from the lateral branch passage in the valve body to a douche applicator. A siphon tube communicates at its upper end with the throat of the venture passageway and extends down into the container bottle below the mixing head. Water flowing through the venturi passageway withdraws liquid medicament from the container bottle through the siphon tube. A manually adjustable knob enables the user to selectively control the rate of withdrawal of liquid medicament from the container bottle into the venturi passageway in the mixing head. The fitting which connects the mixing head to the valve body is rotatively adjustable so that the siphon tube can be vertically positioned.

A principal object of this invention is to provide a novel douche apparatus for attachment to a conventional shower.

Another object of this invention is to provide such an apparatus which enables the shower to be operated in the usual way or turned off and its water supply used for operating the douche apparatus.

Another object of this invention is to provide a novel douche apparatus for attachment to a shower and having means for adjusting the flow rate of a liquid douche medicament which becomes mixed with the shower supply water.

Another object of this invention is to provide a novel douche apparatus for attachment to a conventional shower and having a liquid douche medicament container with a siphon tube selectively adjustable to a vertical position to insure the proper withdrawal of the medicament from the container.

Further objects and advantages of this invention will be apparent from the following detailed description of presently preferred embodiments shown in the accompanying drawings.

Before explaining the disclosed embodiments of the present invention in detail it is to be understood that the invention is not limited in its application to the details of the particular arrangements shown, since the invention is capable of other embodiments. Also, the terminology used herein is for the purpsoe of description and not limitation.

DETAILED DESCRIPTION

FIGS. 1–8

Figures 1, 2, 3, 4:
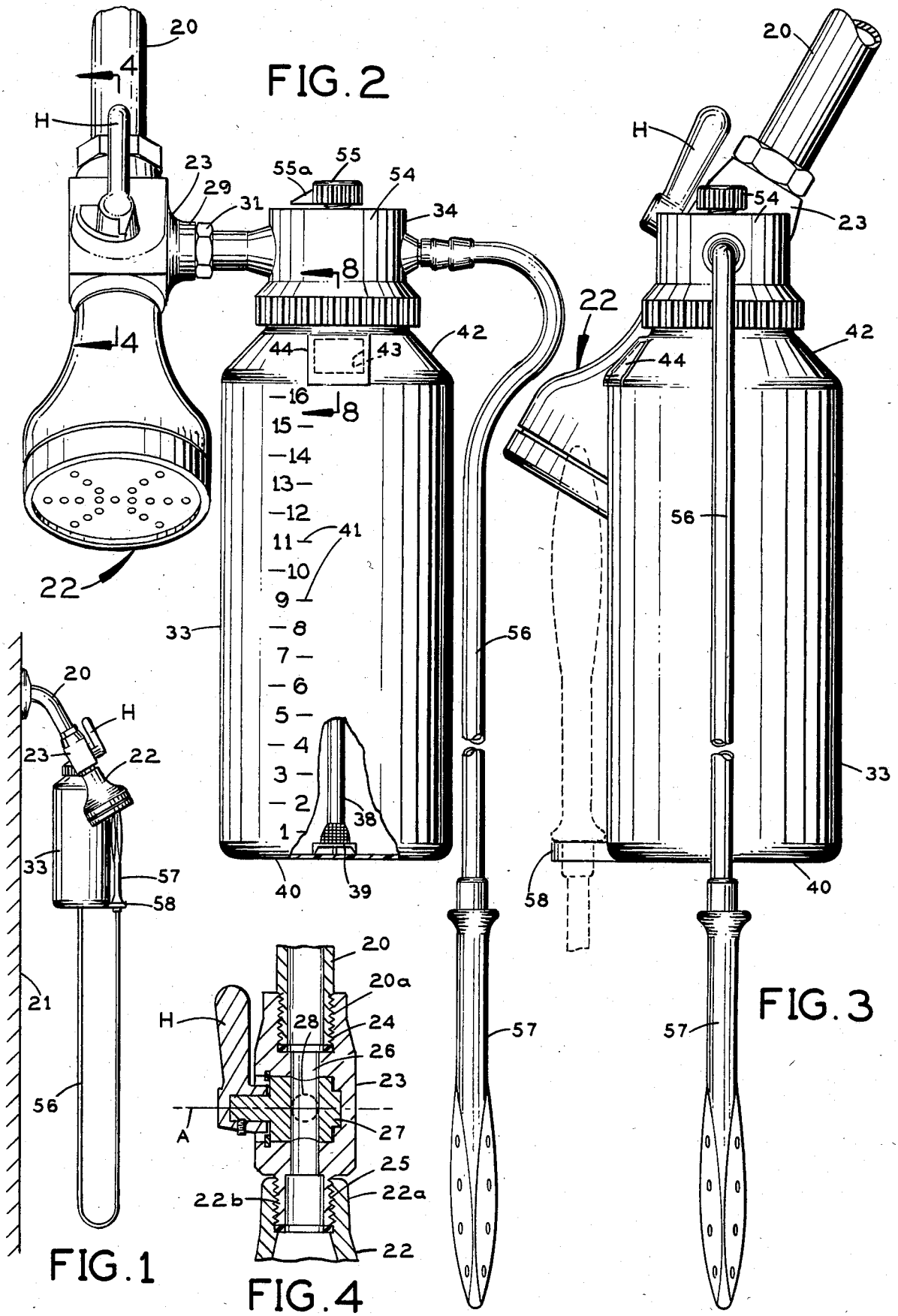
FIG. 1 is a side elevation of a bathroom shower equipped with a first embodiment of the present douche apparatus.
FIG. 2 is a front elevation of this assembly with certain parts broken away.
FIG. 3 is an elevational view taken from the right side of FIG. 2.
FIG. 4 is a fragmentary vertical section taken along the line 4—4 in FIG. 2 through the valve which controls the flow of water to the shower head and to the douche applicator.

As shown in FIG. 1, a typical shower in a residence, hotel or motel has a rigid water supply pipe 20 extending forward and downward at an acute angle from a vertical wall 21 of the shower enclosure. The angle of the outer end of the water supply pipe to the wall may vary from one shower to another. As shown in FIG. 4, at its extreme outer end the water supply pipe is externally screw-threaded at 20*a*. A shower head 22 of known design has a reduced neck 22*a* at its inner end which is internally screw-threaded at 22*b* so as to be threadedly attachable to and detachable from the screw-threaded outer end 20*a* of the water supply pipe 20. Normally, the shower head would be directly mounted on the water supply pipe in this manner.

In accordance with the present invention, a rigid valve body 23 is interposed between the water supply pipe 20 and the shower head 22 to physically support the shower head from the water supply pipe. At its upper end the valve body 23 is internally screw-threaded at 24 (FIG. 4) complementary to the externally screw-threaded end 20*a* of the water supply pipe so that this end of the valve body can be screw-threadedly attached to and removed from the water supply pipe. At its lower end the valve body 23 is externally screw-threaded at 25 complementary to the internally screw-threaded neck of the shower head at 22*b* so that the shower head can be screw-threadedly attached to and removed from this end of the valve body.

The valve body 23 is formed with a straight longitudinal water passageway 26 extending between its screw-threaded opposite ends 24 and 25. A rotary valve member 27 with a T-shaped water passage is positioned in this passageway in valve body 23 to control the flow of water through it. Valve member 27 is rotatably adjustable about an axis A in FIG. 4. In a first rotative position, shown in FIG. 4, valve member 27 provides a substantially unobstructed flow path for water from the water inlet pipe 20 to the shower head 22. The valve member has a second rotative position, 90 degrees counterclockwise from the first position, viewed from the front, in which it completely blocks the flow of water to the shower head 22 and instead connects the water supply pipe 20 to a lateral passageway 28 (FIG. 4) which extends through a neck 29 (FIG. 2) on one side of the valve body. Valve member 27 has a third position in which it blocks the water supply pipe 20 from both the shower head 22 and the lateral passageway 28.

The valve body 23 and valve member 27 together constitute a directional valve of known design which enables the water supply to be connected selectively either to the shower head 22 or to the branch passageway 28, or shut off from both of them.

A handle H, located outside the valve body 23, is rigidly attached to the rotatably adjustable valve member 27. This handle may be turned to put this valve in its off position or its shower position or its lateral position for douche purposes.

Figure 7:
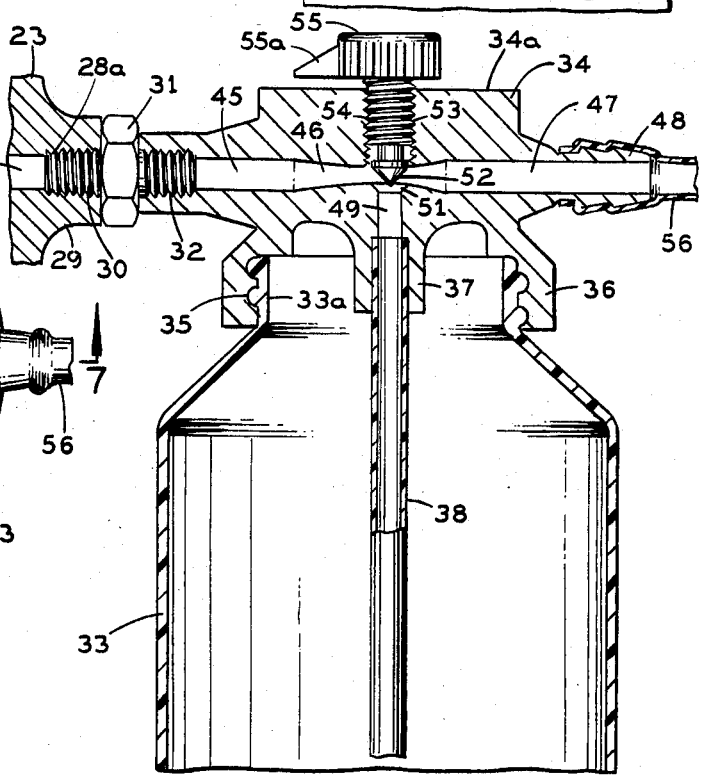
FIG. 7 is a vertical section taken along the line 7—7 in FIG. 6.

As shown in FIG. 7, the outer end of lateral passageway 28 in valve body 23 is screw-threaded at 28*a* to threadedly receive the complementary end of a nipple 30 extending axially from a hexagonal head 31 which abuts against the outer end of the valve body neck 29. A similar screw-threaded nipple 32 extends from the hex head 31 on the opposite side. The hex head 31 and its opposite, screw-threaded end nipples 30 and 32 together constitute a one-piece fitting for mounting a douche container assembly on valve body 23.

The douche container assembly comprises a hollow container vessel in the form of a bottle 33 and a rigid mixing head 34 which is the top closure for container bottle. The container bottle has a reduced neck 33*a* at the top which is externally screw-threaded at 35. The mixing head 34 has an annular collar 36 on the bottom which is internally screw-threaded for threaded attachment to the top neck 33*a* of the container bottle.

On the bottom the mixing head has a downwardly-projecting, centrally positioned, annular projection 37 which holds the upper end of a siphon tube 38. As shown in FIG. 2, the siphon tube extends down into the container bottle and has a strainer 39 on its lower end which rests on the flat bottom wall 40 of the container bottle.

Figure 8:
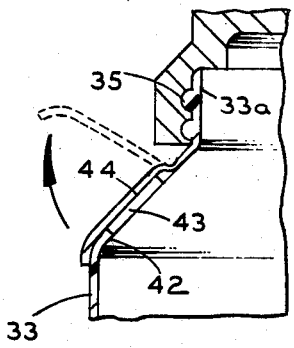
FIG. 8 is a fragmentary vertical section taken at the fill opening for the douche container.

Preferably, the container bottle 33 is transparent or translucent and on the outside it has calibration lines 41 at even intervals from bottom to top which are numbered to indicate the amount of liquid medicament at that level in the container, such as in ounces. Just below its top neck the container has a tapered annular segment 42 (FIG. 5) in which a fill opening 43 (FIG. 8) is located on one side. This fill opening normally is closed by a flexibly attached flap 44. As shown in FIG. 8, this flap may be raised to the phantom line position to permit refilling of the container without detaching it from the mixing head 34.

As shown in FIG. 7, the mixing head 34 is formed with a horizontal bore 45 extending from fitting nipple 32 to one end of a venturi passageway 46. From the opposite end of the venturi passageway a similar bore 47 extends to a neck 48 projecting from the mixing head on the opposite side from its attachment to valve body 23.

The upper end of the siphon tube 38 in the container opens into a short vertical bore 49 in the mixing head 34. A frusto-conical valve seat 50 extends up from this bore into a short, wider bore 51 which opens into the venturi passageway 46 at its throat. The flow of liquid douche medicament from the container bottle 33 up through the siphon tube 38 into the venturi passageway 46 is controlled by a conical valve member 52 immeidately above the valve seat 50. Valve member 52 is on the lower end of a vertical stem having an externally screw-threaded segment 53 threadedly received in a screw-threaded opening 54 in the mixing head 34 which extends down from the horizontal top face 34*a* of the mixing head into the throat of the venturi passageway 46.

Figure 5:
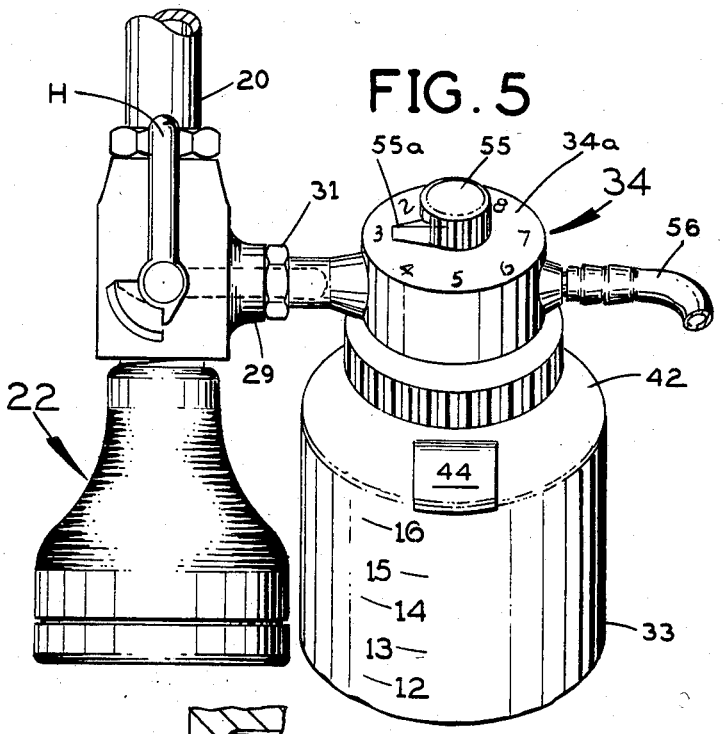
FIG. 5 is a top perspective view of the assembly of FIGS. 2 and 3.

A handle 55 on the upper end of the valve stem has a pointer 55*a* which closely overlies the top face 34*a* of the mixing head 34 of the container. As shown in FIG. 5, the top face of the mixing head has numerical calibrations indicating the flow rate of liquid from the container bottle up into the venturi passageway. When the valve stem pointer 55*a* registers with the number 1, the valve member 52 has its minimum spacing from valve seat 50. When the valve stem is turned counterclockwise from this position, the separation of valve member 52 from valve seat 50 increases and the higher flow rate will be indicated by the higher number to which the valve steam pointer 55*a* now points.

The projecting stem 48 on the right side of the mixing head 34 in FIG. 7 has a series of tapered annular teeth for the secure slip-on attachment of one end of a long flexible hose 56 of rubber-like material. A douche applicator spray device of known design, shown at 57 in FIGS. 2 and 3, is fastened to the opposite end of this hose.

Figure 6:
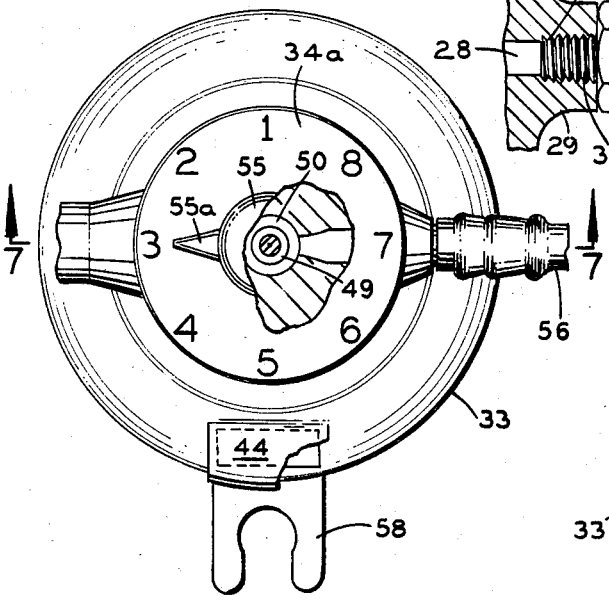
FIG. 6 is a top plan view of the douche container assembly of FIG. 5 with certain parts broken away.

A generally U-shaped holder clip 58 (FIG. 6) extends out from the bottom of container bottle 33 on the same side as the fill opening 43, as shown in FIG. 3. The douche applicator 57 can be seated in this holder clip, as shown in FIGS. 1 and 3, when the douche apparatus is not being used.

This apparatus can be installed in an existing shower after first unscrewing the shower head 22 from the water supply pipe 20. The upper end of the valve body 23 in the present apparatus is screwed onto the water supply pipe 20, and the shower head 22 is screwed onto the lower end of the valve body.

By positioning the handle H of this valve in the shower position, the water supply is connected to the shower head so that a person can take a shower in the usual way.

By turning the handle H to the douche position water coming from the water supply pipe 20 is blocked from the shower head 22 and instead is passed into the lateral passageway 28 in the valve body, from where it flows through the venturi passageway 46 in the mixing head 34 on top of container bottle 33 and from there through hose 56 to the applicator 57. The flow of water through the venturi passageway 46 draws liquid medicament from container bottle 33 up through siphon tube 38 and into the stream of water in the venturi passageway, which mixes with the medicament and dilutes it properly before it is discharged by the applicator 57.

The fitting 30, 31, 32 which attaches the douche container assembly to valve body 23 is rotatively adjustable with respect to both of them so that the container bottle 32 and siphon tube 38 can be adjusted to a vertical position whatever may be the angle of the water supply pipe 20 to the vertical. The vertical positioning of the siphon tube 38 insures that the liquid douche medicament will be drawn up into the venturi passageway 46 in the mixing head 34 as water flows through it.

The flow rate of the liquid douche medicament from the container bottle 33 into the water flowing through the mixing head's venturi passageqay 46 can be selectively controlled manually by turning the knob 55 for valve member 52, as already described.

FIG. 9

Figure 9:
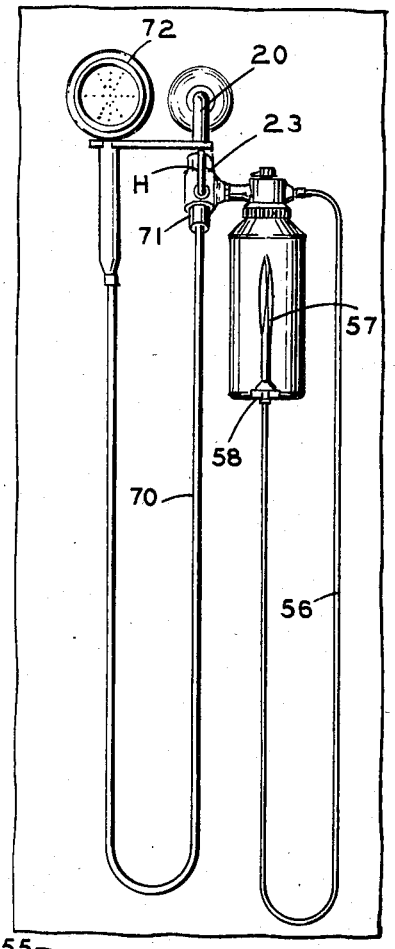
FIG. 9 is a front elevation showing the douche apparatus of FIGS. 2–8 on a shower which has a massaging shower head on the end of a long flexible hose.

The douche apparatus shown in FIG. 9 is identical to the one shown in FIGS. 1–8 and already described in detail.

The FIG. 9 installation differs from FIGS. 1–8 in that the latter's shower head is replaced by an elongated flexible hose 70 extending from a rigid fitting 71 to a massaging shower head 72, which in a known manner can be adjusted to provide a variety of spray patterns, such as pulsating sprays. Fitting 71 is externally screw-threaded at the top for threaded attachment to the lower end of valve body 23.

FIGS. 10–16

In FIGS. 10–16, elements of the installation which correspond to those already described for FIGS. 1–8 are given the same reference numerals plus 100. Therefore, the detailed description of these corresponding elements need not be repeated.

Figures 10, 11, 12, 13, 14, 15, 16:
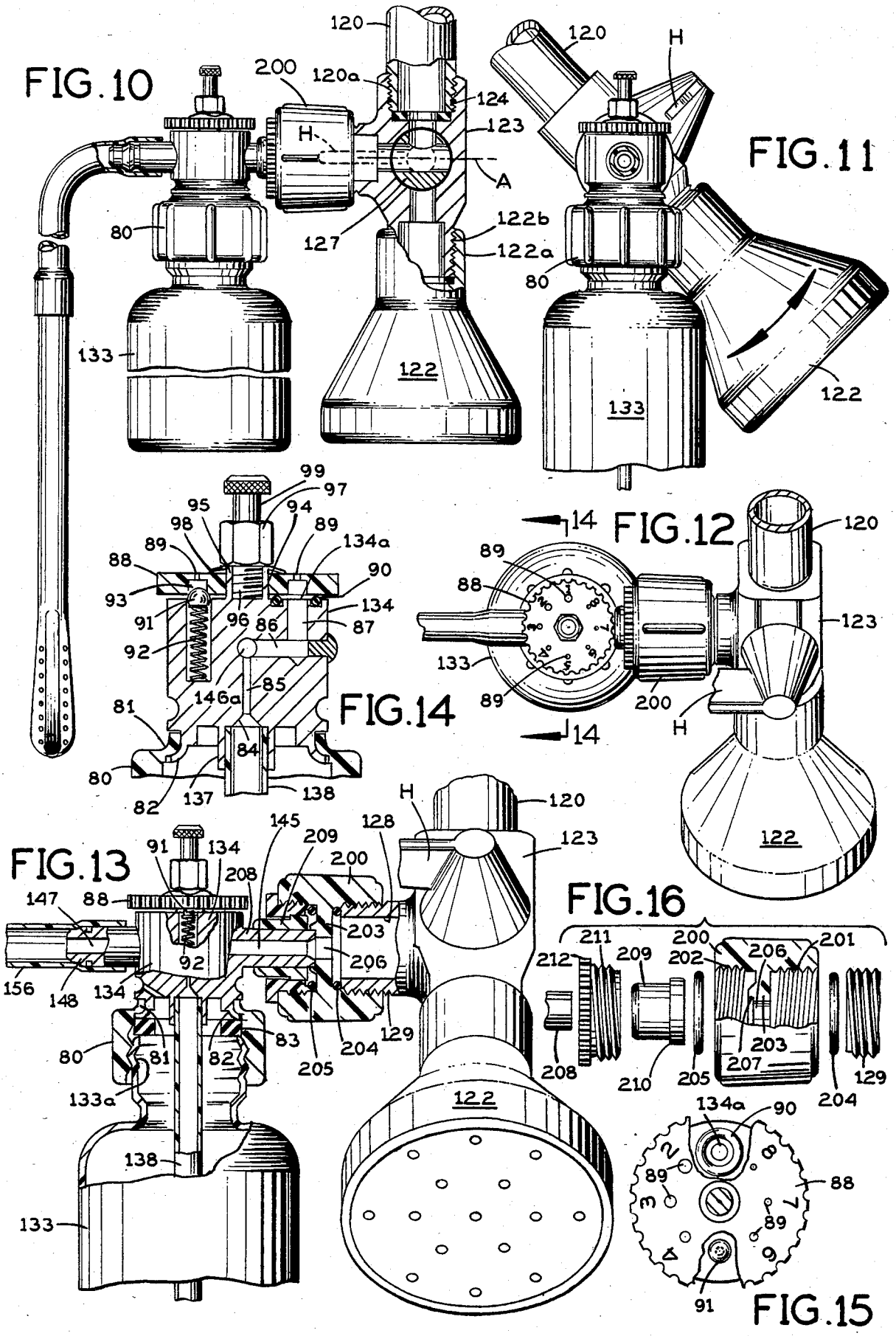
FIG. 10 is a view, generally similar to FIG. 5 but with the valve shown partly in section, of a second embodiment of the present douche apparatus.
FIG. 11 is a partial end elevation taken from the left end of FIG. 10 and with parts broken away.
FIG. 12 is a partial top plan view of the second embodiment of the present douche apparatus attached to a shower.
FIG. 13 is a front plan view, with parts broken away, of the assembly shown in FIGS. 10, 11 and 12.
FIG. 14 is a fragmentary vertical section taken along the line 14—14 in FIG. 12.
FIG. 15 is a fragmentary top plan view showing parts of the flow adjusting arrangement in this second embodiment of the present douche apparatus.
FIG. 16 is an exploded view showing the parts of the fitting in this second embodiment which adjustably mounts the douche container on the valve connected between the water supply pipe and the shower head.

Referring to FIG. 13, the douche medicament vessel 133 and the externally screw-threaded neck **133*a* at the top of this bottle have a slightly different shape from the embodiment of FIGS. 1–8, as does the mixing head 134. The mixing head 134 is attached to the top neck of the container bottle by a separate ring 80 of suitable plastic material which is internally screw-threaded at the bottom for threaded attachment to the container bottle neck 133*a*. At the top the ring has an inwardly and upwardly curved neck 81 which rotatably engages a complementary, curved, annular projection 82 on the bottom of mixing head 134, as shown in enlarged detail in FIG. 14. An O-ring 83 of rubber-like material (FIG. 13) is clamped tightly between the bottom of lip 82 on the mixing head and the top edge of the container bottle neck 133*a***.

The mixing head has a straight, cylindrical entrance passageway 145 leading into a venturi passage which is like the venturi passage 46 in FIG. 7. The outlet end of the venturi passage leads into a straight, cylindrical outlet passageway 147 in the mixing head. The narrow throat of this venturi passageway in mixing head 134 is shown at **146*a* in FIG. 14. The upper end of the siphon tube 138 leads up into this throat of the venturi passageway through an upwardly and inwardly tapered, short passageway 84 in the bottom of the mixing head 134 and a narrow, vertical, cylindrical bore 85 which extends up into the venturi passageway throat. The flow of water through the venturi passage draws liquid douche medicament from the container bottle 133 up through the siphon tube 138 and passageways 84 and 85 in the mixig head into the venturi passage, where it is mixed with the water and is discharged through the outlet passageway 147** of the mixing head.

The reduced neck **146*a* of the venturi passageway in the mixing head has restricted communication with the atmosphere through a lateral passage 86 and a vertical passage 87 which is open at the top face 134*a* of the mixing head 134. An apertured flow rate-selection disc 88 is rotatably mounted on top of mixing head 134. This disc has a plurality of angularly spaced bleed openings 89 of different sizes which are selectively registerable individually with the vertical passage 87 in the mixing head. As shown in FIG. 12, these bleed openings 89 are numbered from 1 to 8, the opening at 1 being the largest and the opening at 8 being the smallest. The fluid pressure in the throat 146*a* of the venturi passage is determined in part by the size of the bleed opening 89 in disc 88 which then registers with vertical passage 87** in the mixing head. The fluid pressure in the venturi throat determines the flow rate of liquie douche medicament up through the siphon tube.

An O-ring 90 (FIG. 14) is seated in an annular recess located in the top of mixing head 134 and encircling the open upper end of vertical passage 87. This O-ring sealingly engages the bottom of disc 88 around whichever vent opening 89 in the disc then overlies the mixing head passage 87.

Toward the opposite side of the mixing head, a detent ball 91 is pushed upward by a compressed coil spring 92 into engagement with a counterbore 93 in the disc directly below a corresponding vent opening 89 in the disc. This ball detent holds the disc in whatever rotative postion it has been turned to but its spring holding force can be overcome by a person's turning the disc 88.

The flow rate selector disc 88 has a central circular opening 94 (FIG. 14) which slidably engages an annular neck 95 on the top of mixing head 34. This neck is internally screw-threaded to threadedly receive the screw-threaded stem 96 on the lower end of a clamping nut 97. An annular, wavy, spring metal washer 98 is engaged between the clamping nut and the top of disc 88 around the latter's central opening 94. A clamping bolt 99 has a screw-threaded lower end which is threadedly received in a complementary screw-threaded opening in the top of clamping nut 97.

The rotatively adjustable fitting which connects the douche container assembly to the valve body 123 is shown in exploded form in FIG. 16. It comprises a double-socketed ring 200 of suitable plastic having a screw-threaded recess 201 open at its right end in FIG. 16 and a coaxial screw-threaded recess 202 open at its left end. The ring has a annular, radially disposed, internal wall 203 between the inner ends of its recesses 201 and 202. O-rings 204 and 205 of rubber-like material engage the opposite sides of this internal wall, as shown in FIG. 13.

The lateral projection or stem 129 on valve body 123 is externally screw-threaded for screw-threaded reception in the recess 201 in ring 200. The end of valve body projection 129 sealingly engages the O-ring 204 when ring 200 is tightened on valve body projection 129. The internal wall 203 or ring 200 has a central opening 206 which passes water flowing through the lateral passage 128 in valve body 123.

The left side of the internal wall 203 or ring 200 in FIG. 16 has an annular recess 207 just outside the central opening 206. The mixing head 134 of the douche container assembly has a generally cylindrical stem or projection 208 on one side which provides its water inlet passageway 145. The end of this stem or projection on the mixing head is snugly received in recess 207, as shown in FIG. 13. A flanged, generally cylindrical sleeve 209 is press fitted on the outside of the mixing head projection 208. A flange on the inner end of this sleeve presents an outwardly-facing transverse shoulder 210 (FIG. 16). A hollow, externally screw-threaded, clamping ring 211 is rotatably mounted on sleeve 209. As shown in FIG. 13, this ring has a stepped, central opening which presents a forwardly-facing, transverse, annular shoulder which slidably abuts against the outside shoulder 210 on sleeve 209. The clamping ring 211 is externally screw-threaded for most of its length, where it is threadedly received in recess 202 in ring 200. At its left end in FIGS. 13 and 16, the clamping ring 211 has a laterally projecting head 212 which is positioned just to the left of ring 200. This head has a toothed periphery which enables it to be grasped securely for clamping or loosening the clamping ring 211. The inner end of the clamping ring 211 sealingly engages the O-ring 205 and squeezes it against the internal wall 203 of ring 200 when the clamping ring is tightened.

After the ring 200 has been tightened on the lateral projection or stem 129 of valve body 123, with the clamping ring 211 loosened the mixing head 134 may be rotatively adjusted with respect to the axis of ring 200 to a position in which the siphon tube 138 and the container bottle 133 are vertical. Then the clamping ring 211 is tightened to lock the parts in this position.

I claim:

1. For use with a shower apparatus having:

a water supply pipe with an outlet end;

and a shower head detachably connected to said outlet end of the water supply pipe;

a douche apparatus comprising:

a valve having a valve body with an upper end and a lower end, means on the upper end of said valve body for attaching it to said outlet end of the water supply pipe, means on the lower end of said valve body for attaching it to the shower head, a valve member in said valve body selectively adjustable between a first position in which it establishes a first water flow path from said water supply pipe to said shower head and a second position in which it blocks said first water flow path, said valve body on one side thereof having a laterally extending neck which provides a branch passage extending from said valve member to receive water from said water supply pipe in said second position of the valve member;

a container assembly for holding a liquid douche medicament;

a fitting connecting said container assembly to said laterally extending neck of said valve body for passing water from said branch passage of said valve body;

means in said container assembly for mixing said liquid medicament with the water from said fitting;

and an applicator operatively connected to said container assembly for discharging the mixture of water and said liquid medicament;

said container assembly comprising:

a mixing head coupled to said fitting and having a venturi passageway for passing water from said fitting;

a container vessel below said mixing head; said laterally extending neck on the valve body, said fitting and said mixing head being dimensioned to position said container vessel completely to one side of the shower head;

and a siphon tube extending down into said container vessel and operatively connected at its upper end to the venturi passageway whereby the flow of water through said venturi passageway draws liquid medicament from said container vessel up through said siphon tube and into the venturi passageway in the mixing head.

2. A douche apparatus according to claim 1 wherein:

said fitting is rotatively adjustably attached to said valve body to enable said siphon tube to be positioned vertical.

3. A douche apparatus according to claim 2 wherein:

said mixing head has a fluid passage extending up from the upper end of said siphon tube to said venturi passageway, and said mixing head presents an upwardly-facing valve seat in said fluid passage;

and further comprising:

a valve member in confronting relationship to said valve seat;

and a stem extending up from said valve member and screw-threadedly received in said mixing head for rotative adjustment of said valve member toward and away from said valve seat to control the flow rate of liquid medicament.

4. A douche apparatus according to claim 3 wherein:

said mixing head has a top face with circumferentially spaced calibrations thereon around the axis of said valve stem;

and further comprising:

a handle closely overlying said top face of the mixing head and operatively connected to said valve stem for rotatively adjusting the latter, said handle having a pointer for registration selectively with said calibrations.

5. A douche apparatus according to claim 2 wherein:

said mixing head has a top face and an air bleed passage extending from said venturi passageway up to said top face;

and further comprising:

an apertured disc closely overlying said top face of the mixing head and rotatably adjustable on the mixing head, said disc having a plurality of different sized openings which are selectively registerable with said air bleed passage at the top face of the mixing head.

6. A douche apparatus according to claim 5 and further comprising:

an O-ring engaged between said mixing head and the bottom of said disc around said air bleed passage.

7. A douche apparatus according to claim 6 and further comprising:

spring biased detent means acting between said disc and said mixing head to releasably lock the disc in different rotative positions in which a corresonding opening in the disc registers with said air bleed passage in the mixing head.

8. A douche apparatus according to claim 5 and further comprising:

spring biased detent means acting between said disc and said mixing head to releasably lock the disc in different rotative positions in which a corresponding opening in the disc registers with said air bleed passage in the mixing head.

9. A douche apparatus according to claim 1 wherein:

said mixing head has a fluid passage extending up from the upper end of said siphon tube to said venturi passageway, and said mixing head presents an upwardly-facing valve seat in said fluid passage;

and further comprising:

a valve member in confronting relationship to said valve seat;

and a stem extending up from said valve member and screw-threadedly received in said mixing head for rotative adjustment of said valve member toward and away from said valve seat to control the flow rate of liquid medicament.

10. A douche apparatus according to claim 9 wherein:

said mixing head has a top face with circumferentially spaced calibrations thereon around the axis of said valve stem;

and further comprising:

a handle closely overlying said top face of the mixing head and operatively connected to said valve stem for rotatively adjusting the latter, said handle having a pointer for registration selectively with said calibrations.

11. A douche apparatus according to claim 1 wherein:

said mixing head has a top face and an air bleed passage extending from said venturi passageway up to said top face;

and further comprising:

an apertured disc closely overlying said top face of the mixing head and rotatably adjustable on the mixing head, said disc having a pluality of different sized openings which are selectively registerable with said air bleed passage at the top face of the mixing head.

12. A douche apparatus according to claim 11 and further comprising:

an O-ring engaged between said mixing head and the bottom of said disc around said air bleed passage.

13. A douche apparatus according to claim 11 and further comprising:

spring biased detent means acting between said disc and said mixing head to releasably lock the disc in different rotative positions in which a corresponding opening in the disc registers with said air bleed passage in the mixing head.

14. For use with a shower apparatus having:

a water supply pipe with an outlet end;

15. For use with a shower apparatus having:

a water supply pipe with an outlet end;

and a shower head detachably connected to said outlet end of the water supply pipe;

a douche apparatus comprising:

a valve having a valve body with an upper end and a lower end, means on the upper end of said valve body for attaching it to said outlet end of the water supply pipe and at the opposite end to the shower head, a valve member in said valve body selectively adjustable between a first position in which it establishes a first water flow path from said water supply pipe to said shower head and a second position in which it blocks said first water flow path, said valve body on one side thereof having a laterally extending neck which provides a branch passage extending from said valve member to receive water from said water supply pipe in said second position of the valve member;

a container assembly comprising a container vessel for liquid medicament and a mixing head closing said container at the top and having a venturi passageway with an entrance end and an outlet end;

a siphon tube extending down into said container vessel and comunicating at its upper end with said venturi passageway;

fitting means operatively connecting said mixing head to said laterally extending neck on said valve body to pass water from said branch passage in the valve body into said entrance end of said venturi passageway in the mixing head;

said laterally extending neck on the valve body, said fitting means and said mixing head being dimensioned to position said container vessel completely to one side of the shower head;

and a douche applicator operatively connected in said outlet end of said venturi passageway to said mixing head to receive water and medicament from said venturi passageway.

16. A douche apparatus according to claim 15 wherein:

said fitting means operatively connecting said mixing head to said valve body is a fitting which is rotatively adjustable to position said siphon tube vertical.

17. A douche apparatus according to claim 14 wherein:

said fitting means operatively connecting said mixing head to said valve body is a fitting which is rotatively adjustable to position said siphon tube vertical.

* * * * *